US005819509A

United States Patent [19]

McGregor et al.

[11] Patent Number: 5,819,509

[45] Date of Patent: Oct. 13, 1998

[54] BAG SHOULDERING AND DEAERATING APPARATUS

[76] Inventors: Harold McGregor; James McGregor, both of 1234 Brady Blvd. NW., Owatonna, Minn. 55044

[21] Appl. No.: 800,621

[22] Filed: Feb. 14, 1997

Related U.S. Application Data

[63] Continuation of Ser. No. 369,410, Jan. 6, 1995, abandoned.

[51] Int. Cl.[6] ..... B65B 1/22

[52] U.S. Cl. ..... 53/525; 53/370.6; 53/373.6; 53/570; 53/526

[58] Field of Search ..... 53/437, 459, 469, 53/481, 525, 370.6, 373.6, 570, 571, 282, 526

[56] References Cited

U.S. PATENT DOCUMENTS

| | | | |
|---|---|---|---|
| 2,915,866 | 12/1959 | Bartlo | 53/526 |
| 2,956,383 | 10/1960 | Gansma | 53/526 |
| 3,619,975 | 11/1971 | Johnson et al. | 53/570 |
| 3,855,907 | 12/1974 | Johnson et al. | 53/469 |
| 4,174,599 | 11/1979 | Callet et al. | 53/469 |
| 4,232,504 | 11/1980 | Dieterlen et al. | 53/570 |
| 4,322,932 | 4/1982 | McGregor | 53/370.6 |
| 4,548,826 | 10/1985 | Watkins | 53/459 |
| 5,014,492 | 5/1991 | Fiorini et al. | 53/405 |
| 5,117,750 | 6/1992 | Mosier, III et al. | 53/526 |

*Primary Examiner*—James F. Coan
*Assistant Examiner*—Gene L. Kim
*Attorney, Agent, or Firm*—Moore & Hansen

[57] ABSTRACT

An apparatus for shouldering and deaerating filled bags provides rapid expulsion of excess gas from flexible top-closure bags containing particulate material. The automated apparatus permits completely controlled handling of the filled bags from the filling station through their movement to a bag closing station. The filled bag is transported to the shouldering and deaerating station where a portion of its top edge is clamped and held by upwardly-biased bag grippers while the contents are settled, compacted and degasified by vibration. Pressure rollers mounted on the front and rear of the bag below the bag grippers compressively roll downward to collapse the bag top and expel gas upwardly therefrom. Downward movement of the rollers ceases when indirect contact with the bag contents activates a limit switch or servo mechanism.

17 Claims, 12 Drawing Sheets

BAG SHOULDERING AND DEAERATING APPARATUS

This is a continuation of application Ser. No. 08/369,410, now abandoned, filed, Jan. 6, 1995.

BACKGROUND OF THE INVENTION

This invention relates generally to bag handling machines. More particularly, this invention pertains to apparatus for shouldering and deaerating bags filled with powder or granular materials.

Filled bags having a substantial amount of air-filled space above the materials have a tendency to break open, particularly when stacked in multiple levels such as on a pallet or other surface. The air filled portion of the bag is not supported by the particulate material and may break like a balloon as other bags are piled atop it to create a heavy load. Loss or spoilage of the materials results.

The presence of gas-filled voids in a bag enables the contents to shift within the bag. When placed in multiple layers on a pallet, the stack may be unstable. Furthermore, the useless void volume reduces the quantity of product which may be stored or shipped in a given space.

When bags are filled with powder or granular materials, a considerable quantity of gas, e.g. air is entrained in the interstices of the materials. The bag contents may be compacted by subjecting the bag to vibratory forces, driving the gas from the interstices of the particulate contents and settling the contents. A major portion of the gas above the settled contents must be removed to protect the integrity of the bag and contents during subsequent handling. It is important that any method for minimizing the free space within bags take into account the bag-to-bag differences in bag expansion during filling, and the variations in level to which the bags become filled.

In the bagging of some materials, it has been found that the presence of an excessive quantity of moisture containing air within the bag may lead to oxidation and spoilage of the contents. While the substitution of a dry non-oxidizing gas for the air may be used, it may also be possible to limit or eliminate the spoilage merely by eliminating the excessive quantity of air in the bag.

BRIEF SUMMARY OF THE INVENTION

This invention comprises an apparatus and method for shouldering and deaerating a filled bag. The invention is particularly useful in continuous or semi-continuous bag filling and sealing installations exemplified by those used for bagging chemicals, minerals, grain products and biological materials. The apparatus and method are applicable to gusseted and non-gusseted bags, whether formed of paper, plastic or other material.

In one aspect of the invention, opposing roller assemblies are configured to engage the opposite sides of a bag top and to move downwardly, expressing air upwardly from the upper air space of the bag. The rollers are configured to provide an "escape path" for air, e.g. the rollers may be discontinuous, or of a length shorter than the bag top. Alternatively, the roller compression may be limited so that air or gas may escape between the closely spaced moving rollers.

In another aspect of the invention, means for detecting the "shoulder" of the bag contents and discontinuing the downward rolling action are provided.

In a further aspect of the invention, a bag top gripping assembly is provided which engages and clamps onto the upper edge or an upper portion of the bag, for moving the bag from a prior location to the shouldering/deaerating station and thence to e.g. a sealing station. The shouldering/deaerating station typically includes a vibrating platform or vibrating conveyor for settling the bag contents prior to and/or during the shouldering/deaerating operation.

The construction and operation of the apparatus, as well as the advantages accruing in the use thereof will be readily understood by reading the following description in conjunction with the accompanying figures of the drawings wherein like reference numerals have been applied to designate like elements throughout the several views.

BRIEF DESCRITION OF THE DRAWINGS

DESCRIPTION OF THE PREFERRED EMBODIMENTS

Figure 1:
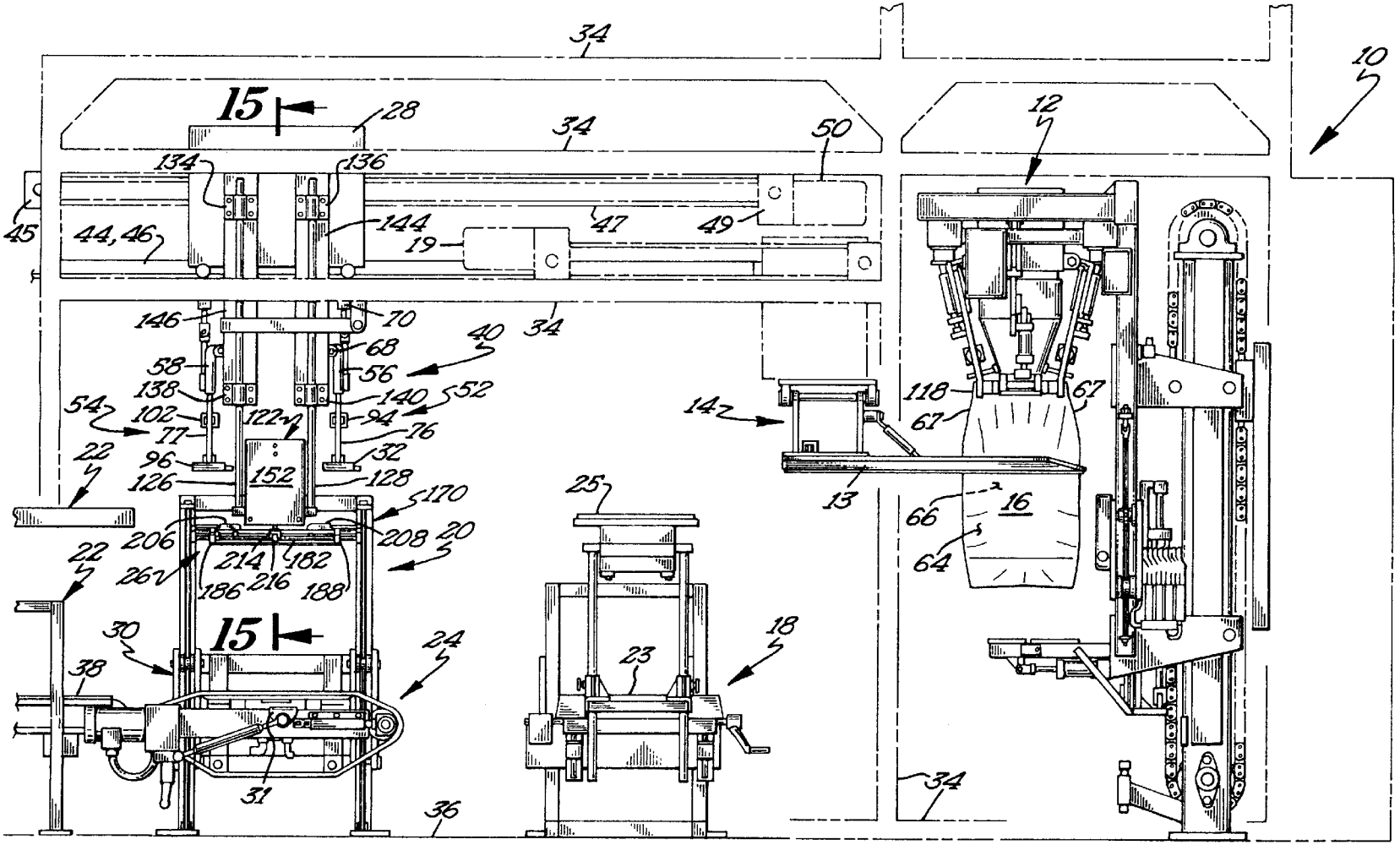
FIG. 1 is a lateral view of an automated bag filling line including the bag shouldering and deaerating apparatus of the invention.

With reference to the drawings, and particularly to FIG. 1, a bag handling line 10 is shown which includes a bag filling station 12, a top forming arm assembly 14 with clamp arms 13 which transfer the filled bag 16 to a check weigh station 18 with a weighing platform 23, and a sealing station 22. Also depicted is a shouldering/deaeration station 20 which includes a stationary lower bag support 30 with a vibrating conveyor 24, and a movable upper portion 40 with a shouldering subassembly 26. Bag filling stations 12, top forming arm assemblies 14, check weigh stations 18, and stationary bag supports 30 with vibrating conveyors 24 are all well known in the art.

The lower stationary bag support 30 is shown mounted on a floor or platform 36. The shouldering subassembly 26 is movably suspended from a travelling car 28 which rides on rails 44, 46. Bag top grippers 32, 33 are also suspended from the traveling car 28 for holding the filled bag 16 during (a) transfer from check weigh station 18 or other location to the vibration conveyor 24, during (b) the deaeration/shouldering operation, and during (c) subsequent transfer to a sealing station 22 or other subsequent stage.

As shown in FIG. 1, a top forming arm assembly 14, includes a movable frame 15 driven on rails 44, 46 by reversible drive motor 19. The rails permit the bag 16 to be carried from the bag filling station 12 to check weigh station 18.

The sealing station 22 is shown with a belt conveyor 38 upon which bags 16 are transported for sewing, gluing, heat sealing or other sealing of the bag closures.

The filing station 12, top forming arm assembly 14, check weigh station 18, travelling car 28 of the upper movable portion, lower stationary bag support 30 and sealing station 22 are shown mounted on a framework 34, depicted in phantom.

While the deaeration/shouldering apparatus 20 is shown as part of a particularly configured filling line 10, it is understood that the invention may be applied to any operation in which bags containing particulate material are to be sealed to contain a minimal amount of "free space", i.e. gas containing space. Thus, the invention is applicable to any filled bag in which opposite sides thereof may be compressed inwardly to eject gas from above the bag contents and reduce the gas space. The invention is useful with a wide variety of bags including bags formed of plastic, fabric or paper. The invention may be configured to handle either gusseted or non-gusseted bags.

The term "deaeration" describes the process of separating entrained gas from materials in the bag 16, thus compacting the materials, and expelling gases from the space overlying the materials in the filled bag. The gas is usually air but it may be another gas used to provide e.g. an inert atmosphere such as $N^{2\ or\ CO}{}_{2}$, and may include volatiles associated with the bagged materials, and water vapor.

The term "shouldering" refers to the process of bringing together the front face 64 and rear face 66 of the filled bag 16 in the bag area above the compacted contents. A shoulder 42 of the filled bag 16 is formed exterior of the upper surface 41 of the compacted bag contents 43 (see FIG. 11), so that the bag wall 21 is closely conformed to the contents. Thus, the amount of space occupied by gas in the bag 16 is minimized.

The removal of excess gas from a bag 16 prior to sealing results in a more compact bag, lessening material movement in the bag, enhancing stacking and palleting capability, and reducing the incidence of bag tearing and breakage in subsequent handling operations.

Turning now to the other figures, essential moving portions of the bag shouldering and deaerating apparatus 20 are shown in greater detail.

Figure 1A:
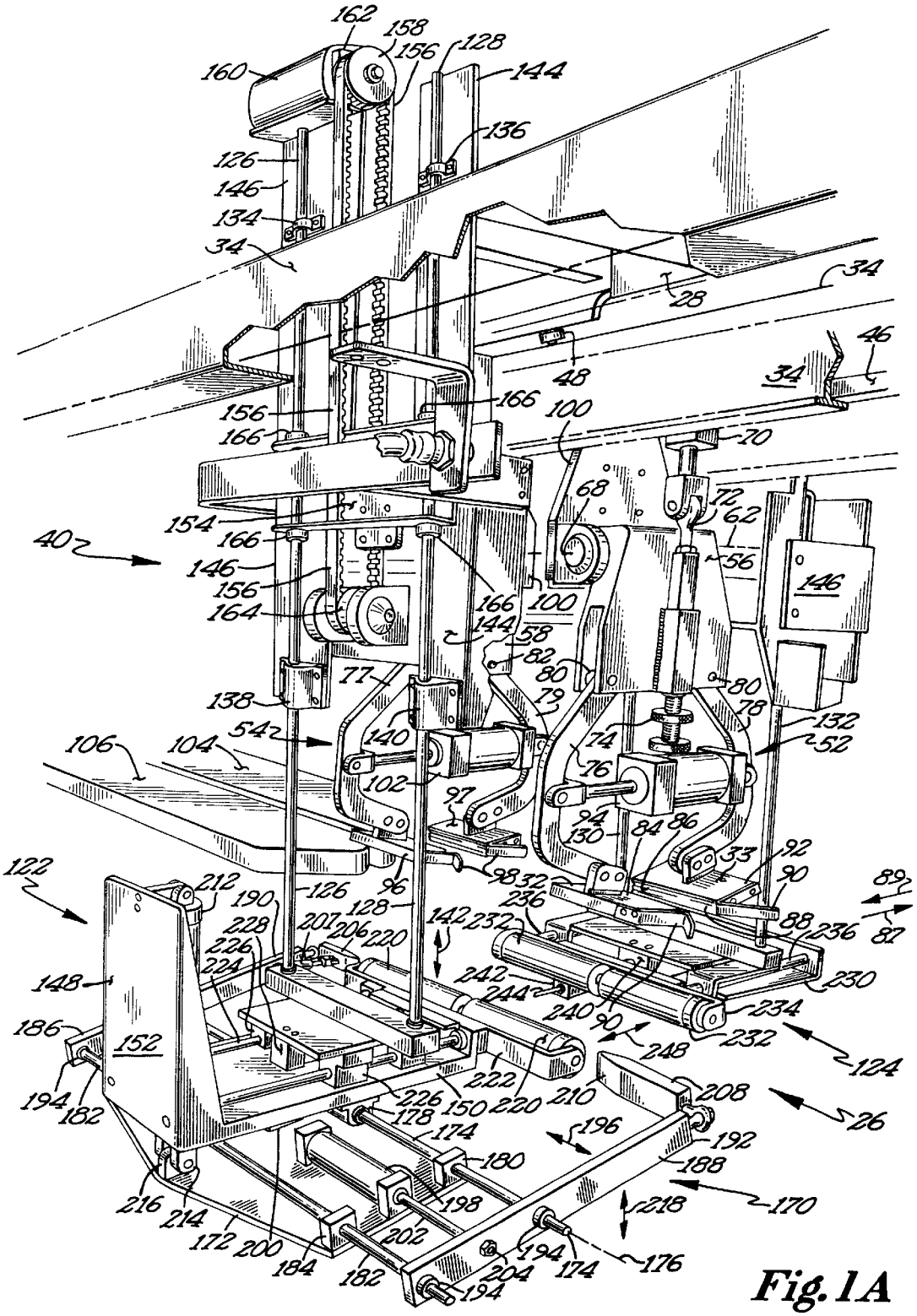
FIG. 1A is a perspective view of the major moving components of the bag shouldering and deaerating apparatus of the invention.

As depicted in FIG. 1A, the upper movable portion 40 of the bag deaerating and shouldering apparatus 20 includes a travelling car 28 which is moved on rollers 48 along parallel horizontal rails 44, 46. The rails 44, 46 are shown attached to the frame 34. The upper movable portion 40 is configured to move from a prior location in the filling line, e.g. the check weigh station 18 (see FIG. 1), where it picks up a filled bag 16 with bag top grippers 32, 33. It then transports the bag 16 to the lower stationary bag support 30 for shouldering and deaeration.

Following deaeration and shouldering, the bag 16 is transported beneath the car 28 to a further location, e.g. a sealing station 22 (see FIG. 1) which typically includes means for sewing, gluing or heat-sealing the bag opening 118 to seal the filled bag 16.

The linear horizontal transport of the bag 16 is accomplished by movement of the travelling car 28 on linear parallel rails 44, 46 as it is driven by a motor 50 such as a servomotor. Typically, a reversible motor 50 drives an endless belt 47 through a rotation indexing apparatus 49 which controls the start/stop positions of the motor. The belt 47 passes about an end sheave 45 and is attached to the travelling car 28 to move it as the belt moves.

Alternatively, a conventional servomotor or other device known in the art may be used to linearly move the travelling car 28.

In any case, the bag 16 is shown as being first moved by a top forming arm assembly 14 from an upstream location such as the bag filling station 12 to a downstream location e.g. a check weigh station 18. The bag 16 is then picked up by bagtop grippers 32, 33 mounted on a travelling car 28 and moved further downstream to a shouldering/deaerating 20 and then to a sealing station 22. The filled bag 16 is shown as travelling in a vertical plane 60 generally bisecting the left and right sides of the bag (see FIG. 4). This plane of movement 60 is such that the plane bisects the bag 16 between its front face 64 and rear face 66.

The filled bag 16 is carried to and from the lower stationary bag support 30 by an upstream bagtop gripper assembly 52 and a downstream bagtop gripper assembly 54. The upstream bagtop gripper assembly 52 is illustrative of both gripper assemblies 52, 54, and is further described herein.

As illustrated in FIG. 1A, the bagtop gripper assembly 52 includes a first (or upstream) arm holder 56 which is pivotally attached to the drop frame 100 about a transverse axis 62 through hinge pin 68. The drop frame 100 is movably attached to the travelling car 28 for reversible vertical movement relative thereto. The vertical movement of the drop frame 100 results in identical vertical motion of the first and second gripper assemblies 52, 54 to lower or lift the bag 16 in unison.

The first arm holder 56 is attached to a double acting fluid actuated cylinder 70 through link 72. Link 72 is connected to the upper carriage 56 for rapid adjustment by an adjustment thumbscrew 74. Activation of the cylinder 70 to draw the link 72 upwardly rotates the arm holder 56 in an upstream direction 87. Likewise, when the link 72 is lowered, the arm holder 56 is rotated in a downstream direction 89 about transverse axis 62 through hinge pin 68.

Depending from the front and rear of the first arm holder 56 are bagtop gripper arms 76, 78. The arms, herein designated as front arm 76 and rear arm 78, are pivotally attached at their upper ends to the first arm holder 56 by pins 80 to pivot transversely between an open bag release position (see FIG. 4) and a bag clamped closed position (see FIG. 7).

As further shown in FIG. 1A, a front bag top clamp or gripper 32 and a rear bag top clamp or gripper 33 are attached to the lower ends of the front bagtop gripper arm 76 and rear bagtop gripper arm 78, respectively. Gripper 32 has a generally horizontal elongate surface 84 which is engagable and compressible against the front face 64 of a bag 16. Likewise, gripper 34 has a like surface 86 which is engagable and compressible against the rear face 66 of the bag 16. An upper portion of the bag 16 is compressed between the gripper surfaces 84, 86. As shown, the surfaces 84, 86 include intermeshing surface discontin15 or 88 such as a tongue-and-groove or ribbed configuration for maintaining a secure grip on the bag 16 while in the bag clamping closed position during transport and shouldering.

The upstream end 92 of each bagtop gripper 32 and 33 is shown with an attached bagtop guide 90. The guides 90 are angled or curved outwardly from the grippers 32, 33 and guide the bagtop into the relatively narrow spacing between the grippers 32, 33 for proper alignment as the grippers are clamped onto an upper portion of the bag 16.

As shown, the front arm 76 and rear arm 78 are pivotally connected by a double acting fluid cylinder 94 for moving grippers 32 and 33 together for gripping the bag 16, and for moving the grippers apart to release the bag. Arms 76 and 78 are shown as having an outwardly bowed shape to accommodate the cylinder 94 therebetween.

A second (or downstream) arm holder 58 is connected to the drop frame 100 in a similar manner as, and longitudinally aligned with the first arm holder 56. The second arm holder 58 is constructed to cooperate with the first arm holder 56 in firmly holding and carrying the filled bag 16. Depending from the front and rear of the second arm holder 58 is a pair of bagtop gripper arms 77 and 79, which are pivotally attached at their upper ends to the second arm holder 58 by pins 82 to pivot in the same manner as corresponding arms 76 and 78. Front gripper 96 and rear gripper 97 are attached to the lower ends of front arm 77 and rear arm 79, respectively. The upstream end of each gripper 96, 97 has a bagtop guide 98 similar to the guides 90 of grippers 32, 33. The front arm 77 and rear arm 79 are connected by a double acting fluid cylinder 102 which opens and closes the arms in the same manner as bagtop gripper arms 76, 78.

Like the first arm holder 56, the second arm holder 58 is pivotally connected to the drop frame 100 to be pivotally between a downstream direction and an upstream direction. Thus, after the upstream grippers 32, 33 and downstream grippers 96, 97 are clamped onto an upper portion of a bag 16, the cylinders 94, 102 may be activated to move the upstream arms 76, 78 and downstream arms 77, 79 away from each other and stretch the upper portion of the bag. The upper portion of the bag 16, with its opening 118, is stretched tautly to keep it in a generally closed, but of course, unsealed condition.

Figure 15:
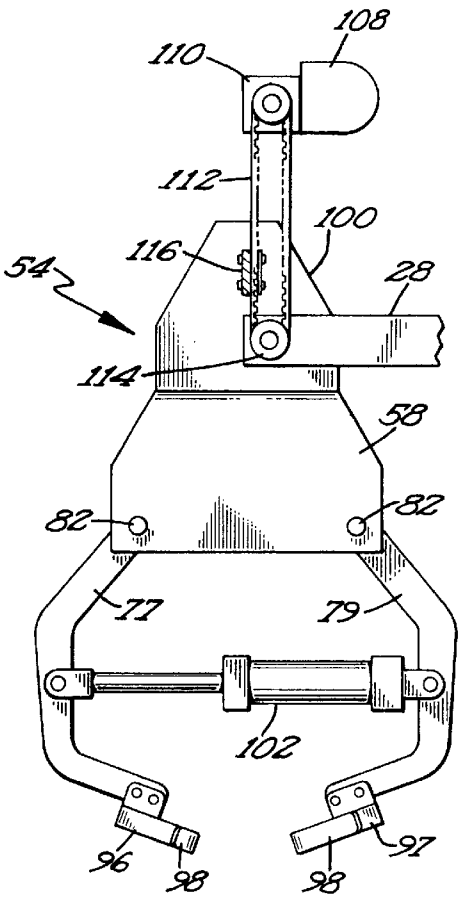
FIG. 15 is a partial end view of a drop frame of the invention, including the vertical drive apparatus, as taken along line 15—15 of FIG. 1.

The drop frame 100 with its attached bagtop gripper assemblies 52 and 54 is adapted to ride with the travelling car 42. The drop frame 100 is also vertically movable relative to the travelling car 42, e.g. by activation of one or two reversible drive motors 108, as illustrated in FIG. 15. A drivemotor 108 is shown with an indexing apparatus 110 by which a continuous vertically oriented belt 112 is driven about a sheave 114 mounted to the travelling car 28. The belt 112 is attached to a portion 116 of the drop frame 100 so that as the belt is turned, it raises or lowers the drop frame. Alternatively, a conventional linear servomotor may be used to raise and lower the drop frame 100.

Thus, a filled bag 16 may be lifted and carried from station to station, or lowered onto e.g. a vibrating conveyor 24 (see FIG. 1A). In FIG. 1A, bag guides 104 and 106 of a bag sealing station 12 are shown downstream of the shouldering apparatus for receiving a filled bag 16 which has been deaerated and shouldered. The bagtop may be closed and sealed by sewing, heat sealing, or with an adhesive.

Suspended from the travelling car 42 are a front shouldering assembly 122 and a rear shouldering assembly 124, as depicted in FIG. 1A. The two shouldering assemblies 122, 124 are configured to move horizontally with the travelling car as well as move in a vertical direction 142. Each assembly 122, 124 includes two vertical slide rods, i.e. slide rods 126, 128 of front assembly 122 and slide rods 130, 132 of rear assembly 124, respectively. The vertical slide rods are slidably attached to the front pendant portion 144 and rear pendant portion 146 of the travelling car 42 for vertical movement. The front slide rods 126, 128 pass vertically through upper guide bearings 134 and 136 and lower guide bearings 138 and 140. The rear slide rods 130 and 132 also slide vertically through similar upper and lower guide bearings, not visible in this view. The guide bearings for the vertical slide rods 126, 128, and 130, 132 are mounted on front pendant portion 144 and rear pendant portion 146, respectively, of the travelling car 42.

An adjustable front crosspiece 154 is adjustably mounted on the front slide rods 126, 128 of the front shouldering assembly 122 with lockable slide rings 166. A reversible drive motor 160 is mounted on the front pendant portion 144 and drives a first vertical belt 156 through a drive sheave 158 and an indexing apparatus 162. The belt 156 also passes over a second sheave 164 mounted on a lower part of the front pendant portion 144. The belt 156 is connected to the front crosspiece 154 so that vertical movement of the belt controllably drives the front slide rods 126, 128 up and down. The front shouldering assembly 122 is thus moved up and down by drive motor 160.

The rear shouldering assembly 124 is configured in the same manner as the front shouldering assembly 122. The two assemblies 122, 124 are thus moved up and down in unison.

While the front shouldering assembly is shown as vertically motivated by a drive motor 160 with an indexing apparatus 162, as commercially available, a conventional linear servomotor or other mechanical device may alternatively be used to drive the slide rods 126, 128 in a vertical direction.

The front shouldering assembly 122 is shown in FIG. 1A as including a front frame 148 having a horizontal portion 150 and a vertical portion 152. The front frame 148 is rigidly connected to the vertical front slide rods 126, 128 so that it may be moved up and down in unison with the rear frame 158 in vertical direction 142.

For deaeration and shouldering of bags which have gusseted sides 67 (see FIG. 4), a gusset aligning or tucking device 170 is pivotally connected to the front shouldering assembly 122. The device 170 tucks, aligns and maintains the gussets between the bag faces during the shouldering operation. Device 170 includes a pivot plate 172. Connected to the plate 172 by mounts 180 is a first rod 174 aligned along axis 176 and passing through a bearing 178 mounted on the underside of the front frame 148. A second rod 182 is connected to the plate 172 by mounts 184 and is horizontally spaced from the first rod 174. The first and second rods 174, 182 extend outwardly from the plate 172 on both the left and right sides thereof and act as slide rods upon which a left gusset tucker arm 186 and an opposed right gussett tucker arm 188 are mounted in slide bearings 194. The elongate tucker arms 186, 188 have distal ends 190, 192, respectively, which extend toward the left and right sides of a filled bag 16 which is held by the bag top grippers 32, 33, 96 and 97. The opposed tucker arms 186, 188 are reversibly moved in direction 196 by opposed double acting fluid cylinders 200 and 198 mounted on the pivot plate 172. Right fluid cylinder 198 is shown with a shaft 202 connected to the right tucker arm 188 by a nut 204.

Mounted at the distal end of right tucker arm 188, and at a generally right angle to it, is a tucker finger 208. The tucker finger 208 has a smooth free end 210 configured to be drawn into the gusset on the right side of a filled bag, not shown in FIG. 1A. A left tucker finger 206 is attached to the left tucker arm 186 and is configured to be drawn into the gusset on the left side of the bag. The left tucker arm 186 is shown with an attached double acting fluid cylinder 207. The cylinder 207 is also attached to the left gusset tucker finger 206 for drawing the tucker finger out of the path of the bag 16 as it exits the shouldering/deaerating station 20.

A vertical double acting fluid cylinder 212 is mounted on the vertical portion 152 of the front frame 148. The shaft 214 of the cylinder 212 is mounted on a connector 216 on the pivot plate 172, so that reversible actuation of the cylinder 212 pivots the pivot plate 172 about axis 176 to raise or lower the tucker arms 186 and 188 in direction 218.

Either gusseted or non-gusseted bags may be shouldered and deaerated by the device 20. If the shouldering and deaerating device 20 is to be used with non-gusseted bags only, the entire gusset tucking device 170 may optionally be deleted.

Also attached to the front frame 148 of the front shouldering assembly 122 is a roller or rollers 220 mounted to rotate in holder 222. The holder 222 is mounted on two slide rods 224 which slidably pass through linear slide bearings 226. A double acting fluid cylinder 228 is mounted on the front frame 148 and is connected to the holder 222 to move the roller(s) 220 toward and away from the front face 64 of a filled bag 16 (see FIG. 1).

The rear shouldering assembly 124 is shown as having the same basic construction as the front shouldering assembly 122, except that it has no gusset aligning device like the gusset aligning device 170 of the front shouldering assembly as previously described.

The rear shouldering assembly 124 includes a rear frame 230 mounted on the lower end of rear slide rods 130, 132. Attached to the rear frame 230 is a roller or rollers 232 mounted to rotate in holder 234. The holder 234 is mounted on two slide rods 236 which slidably pass through linear slide bearings 238. A two-way fluid cylinder 240 is mounted on the rear frame 230 and is connected to the holder 234 to move the roller(s) 232 toward and away from the rear face 66 of the filled bag 16 (see FIG. 1). Thus, the front roller 220 and rear roller 232 are movable between retracted positions whereby they are at a spaced apart distance 248, and bag rolling positions where they together grip the bag. The rollers 220, 232 are being biased toward each other for accommodating varied bag wall thickness.

Like the front shouldering assembly 122, the rear shouldering assembly 124 is moved up and down by a drive motor acting through an indexing control mechanism and a vertical belt. This drive apparatus is not visible in FIG. 1A but is like that of the front shouldering assembly 122. Alternatively, the rear shouldering assembly 124 may be driven by a conventional servomotor such as is known in the art. In operation, the front and rear shouldering assemblies 122 and 124 are typically moved up and down in unison.

It should be noted that the bagtop gripper assemblies 52 and 54 as well as the shouldering assemblies 122 and 124 all move with the travelling car 28 as it moves on rails 44, 46.

As shown in FIG. 1A, a limit switch 242 with an extending actuator 244 is attached to the rear shouldering assembly 124 below the roller(s) 232. As the rollers 220 and 232 are moved downward to deaerate the filled bag 16, the actuator 244 slightly precedes the rollers. As the rollers 220 and 232 approach the outwardly extending shoulders 42 of the bag, the actuator 244 contacts the shoulder 42 and is pushed upward thereby to activate the limit switch 242, stopping the drive motors 160 to halt downward motion of the shouldering assemblies 122, 124. The limit switch 242 may be mounted on either of the front or rear shouldering assemblies 122, 124.

In another embodiment, drive motors 160 are torque limitable servomotors. When the rollers 220, 232 reach the shoulders of the bag, the required torque to further lower the rollers exceeds a preset limit, slip in the servomotor prevents the rollers from proceeding further downward. The servomotor then stops, the rollers are retracted, and the servomotor reverses to lift the shouldering assemblies 122, 124.

Figure 14A:
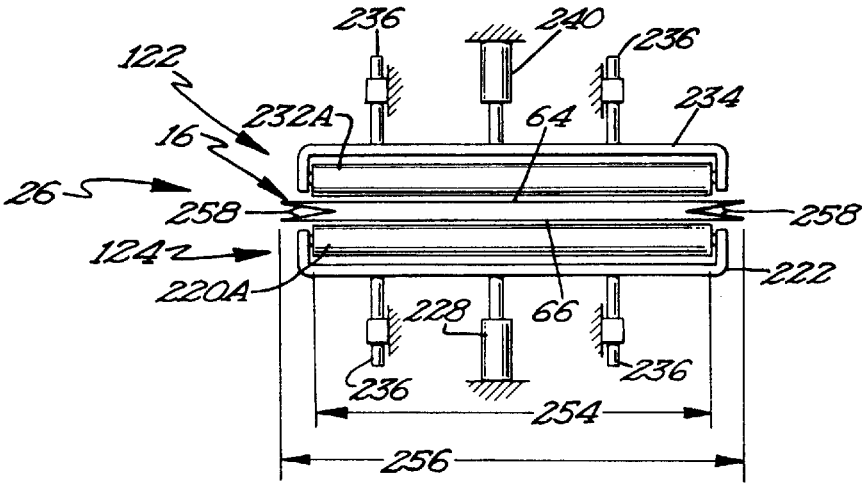
FIG. 14A is a top view of a set of shouldering rollers of the invention.
Figure 14B:
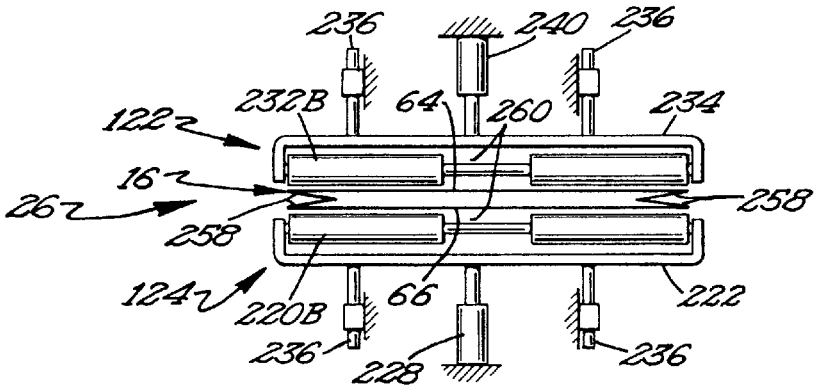
FIG. 14B is a top view of another embodiment of a set of shouldering rollers of the invention.
Figure 14C:
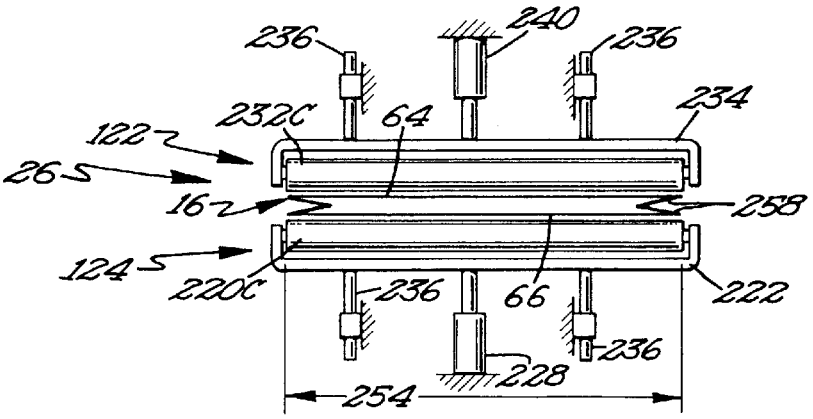
FIG. 14C is a top view of a further embodiment of a set of shouldering rollers of the invention.

The rollers 220, 232 may take varied configurations, provided only that sufficient clearance exists between the front face 64 and the rear face 66 of bag 16 for gas to be exhausted from the bag as the rollers descend. Several exemplary roller configurations are shown in FIGS. 14A, 14B and 14C. In one embodiment, depicted in FIG. 14A. The rollers have a continuous length 254 which extends continuously for a major portion of the bag width 256. During shouldering, gas escapes principally through the gusset portions 258 at the ends of the rollers 220A, 232A.

In the embodiment of FIG. 14B, split rollers 220B, 232B are shown which are as long as the bag width 256, but with matching spaces 260 for relieving gas pressure in the bag 16.

Various combinations of the embodiments of FIGS. 14A and 14B may be used as desired.

In FIG. 14C, the rollers 220C and 232C are shown as extending completely across the bag width 256. The pressure exerted by these rollers on the bag faces is controlled such that gas pressure in the bag created by shouldering is sufficient to slightly push the rollers apart and allow gas to escape upward from the bag.

Figure 16:
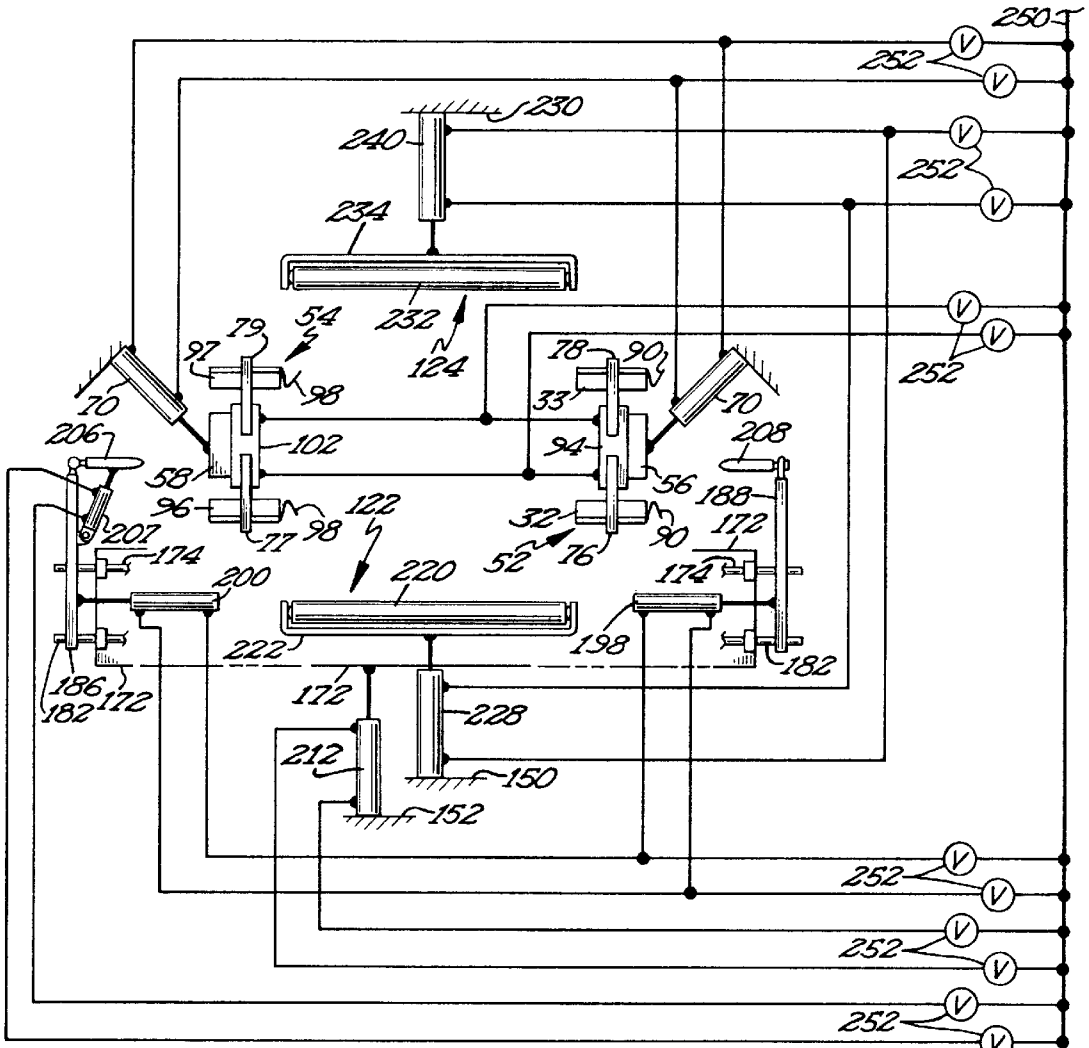
FIG. 16 is a schematic view of a fluid cylinder control system for actuating the moving parts of a bag shouldering and deaerating apparatus of the invention.

In a typical shouldering and deaerating apparatus 20 as described herein, double-acting air cylinders provide reversible motion to many of the parts. In FIG. 16, air is passed from an air supply 250 through air control valves, all of which are designated by the numeral 252, to both ends of each double-acting air cylinder. The air cylinders indicated in FIG. 16 include bag-stretching cylinders 70 which drive the bagtop gripper arm holders 56 and 58 apart from each other with a controlled force which stretches the bag 16 without tearing it or dislodging it from the grippers 32, 33, 96 and 97.

Also shown are gripper cylinders 94 and 102 which clamp left grippers 96 and 97 and right grippers 32 and 33 onto the top portion of the bag 16 for transport and for the shouldering operation.

Double-acting air cylinders 228 and 240 drive opposing rollers 220, 232 against the front and rear faces 64, 66 of the filled bag 16 for collapsing the upper portion of the bag.

Also shown in FIG. 16 is pivot plate cylinder 212 which moves pivot plate 172 up and down to raise and lower the tucker fingers 206, 208.

Cylinders 200 and 198 which reversibly drive the gusset tucker arms 186, 188 toward each other and away from each other, are illustrated in FIG. 16. Also shown in the figure is tucker finger cylinder 207 which retracts and extends downstream tucker finger 206.

Exemplary operation steps of the shouldering and deaeration apparatus are illustrated in FIGS. 2, 3, 4, 5, 6, 7, 8, 9, 10, 11, 12 and 13.

Figure 2:
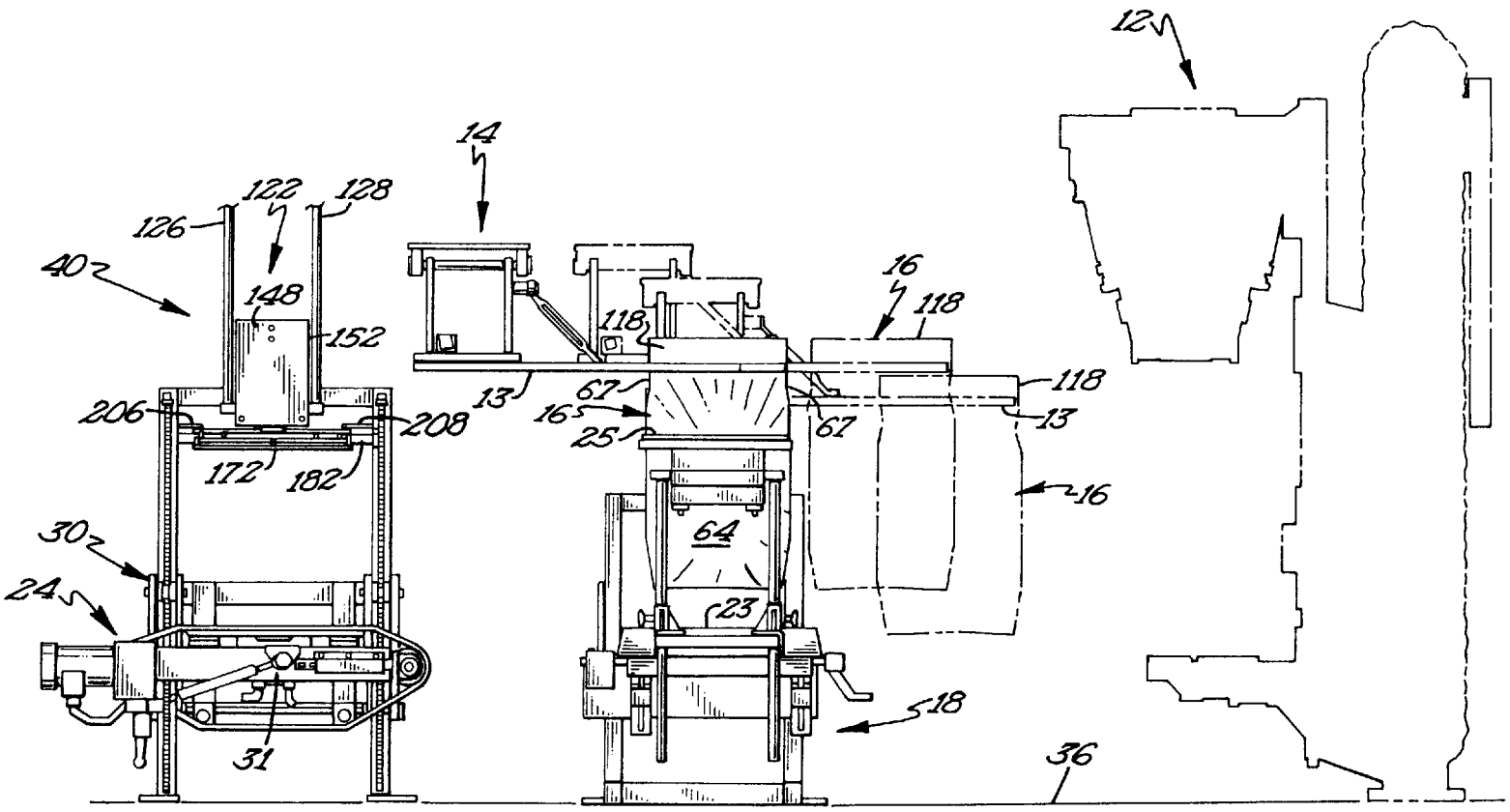
FIG. 2 is a lateral view of an automated bag filling line including a bag shouldering and deaerating apparatus of the invention, showing a filled bag being placed on a check weigh station.

As shown in FIG. 2, a bag 16 with an upper opening 118, having been filled at a bag filling station 12, is transported by bagtop fonning arm assembly 14 with clamp arms 13 to a check weigh station 18. The clamp arms 13 clamp the filled bag 16 near the opening 118. The bag 16 is then lowered by the assembly 14 to rest on the weighing platform 23 for checking the bag weight. Front and rear bag retention arms 25 are extended upwardly and inwardly to engage and hold the upper portion of the bag 16. The upper movable portion 40 of the shouldering device is shown located directly above the lower stationary bag support 30.

Figure 3:
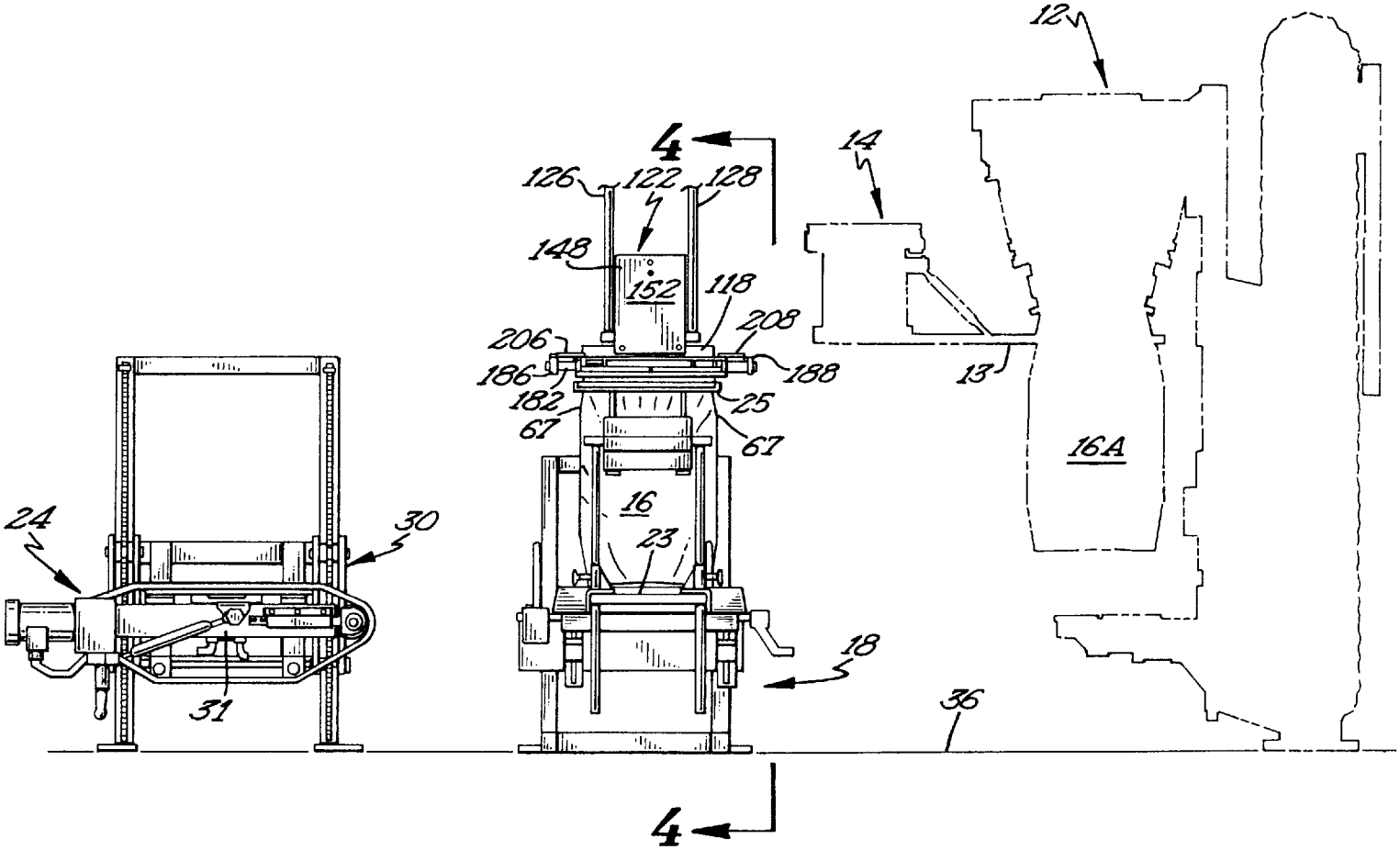
FIG. 3 is a lateral view of an automated bag filling line showing a filled bag being picked up from a check weigh station by a shouldering apparatus of the invention.
Figure 4:
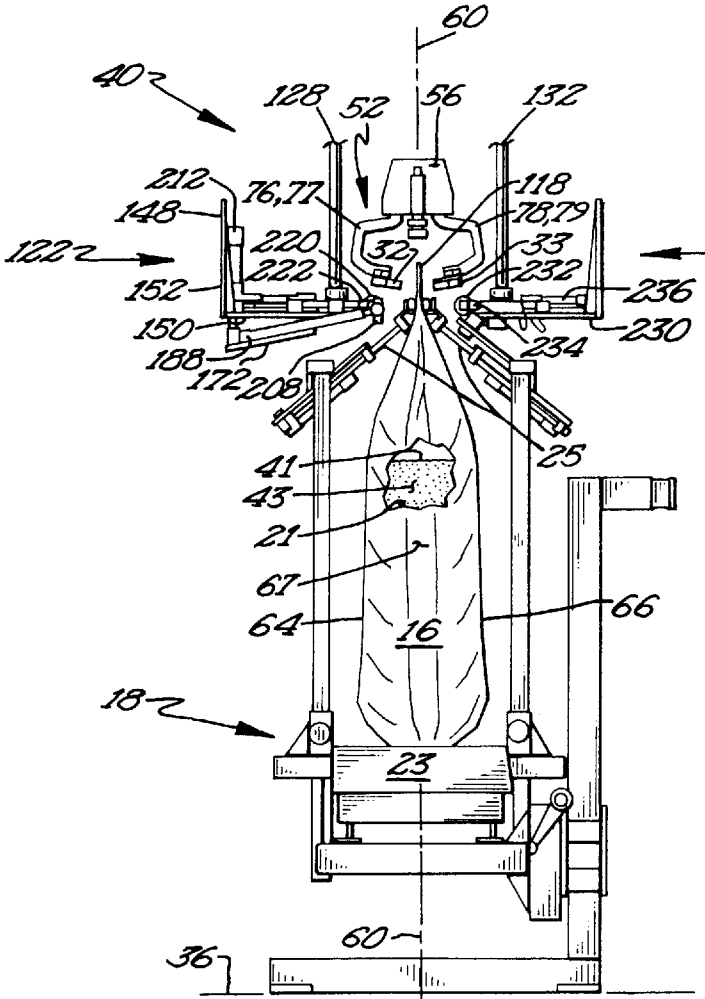
FIG. 4 is an end view of a bag shouldering and deaerating apparatus of the invention, showing a filled bag being picked up from a check weigh station, as taken along line 4—4 of FIG. 3.

As shown in FIGS. 3 and 4, the bagtop forming arm assembly 14 has been unclamped from the bag 16 and returned to the bag filling station 12 to receive another filled bag 16A. The upper movable portion 40 of the shouldering device 20 has been raised to an upper level, moved to the check weigh station 18, and dropped down over the bag 16 to retrieve it and carry it downstream to the lower stationary bag support 30 for deaerating and shouldering. Prior to lowering the shouldering assemblies 122, 124 over bag 16, the roller holders 222 and 234 are retracted, the bagtop gripper arms 76, 77, 78, and 79 are opened, and the gusset tucker fingers 206, 208 are in an upper position, and extended apart from each other, so that they do not contact the bag.

After the shouldering assemblies 122, 124 are lowered over the bagtop, the bagtop gripper arms 76, 77, 78, and 79 are closed to clamp an upper portion of the bag 16. The bag retention arms 25 of the check weigh station 18 are then retracted, permitting the bag 16 to be raised from the weighing platform 23 and moved downstream by the gripper arms.

Figure 5:
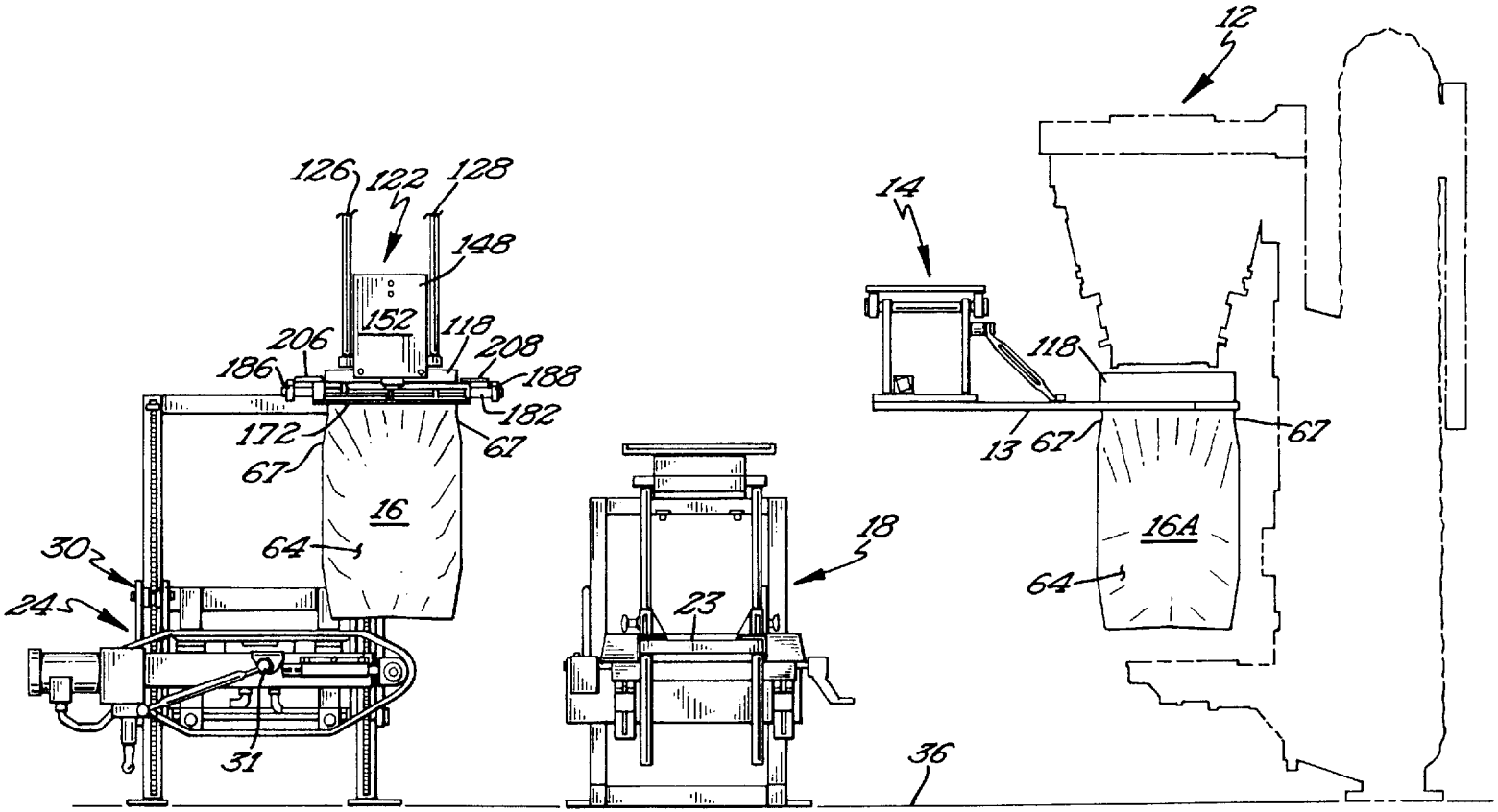
FIG. 5 is a lateral view of an automated bag filling line showing a filled bag being carried to a vibrating conveyor by a bag shouldering and deaerating apparatus of the invention.

As shown in FIG. 5, the bag 16 has been moved from the check weigh station 18, and another filled bag 16A is being picked up by the top forming arm assembly 14 for transport to the check weigh station.

Figure 7:
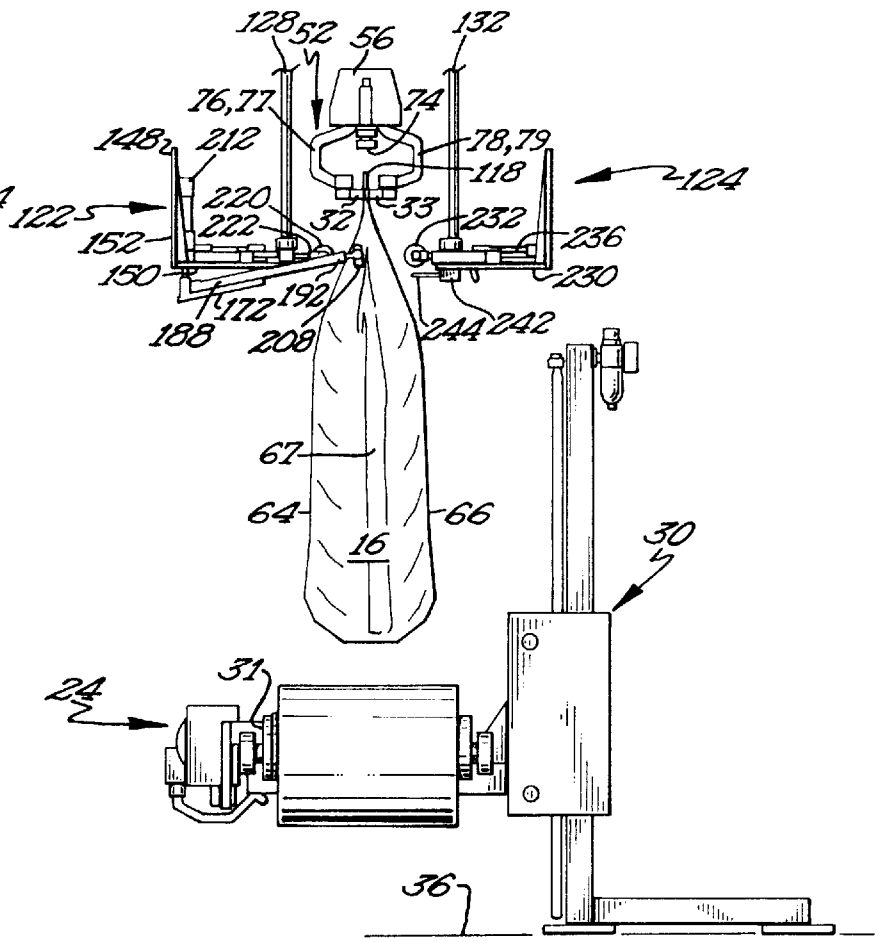
FIG. 7 is an end view of a bag shouldering and deaerating apparatus of the invention, showing a filled bag suspended above a vibrating conveyor, as taken along line 7—7 of FIG. 6.
Figure 6:
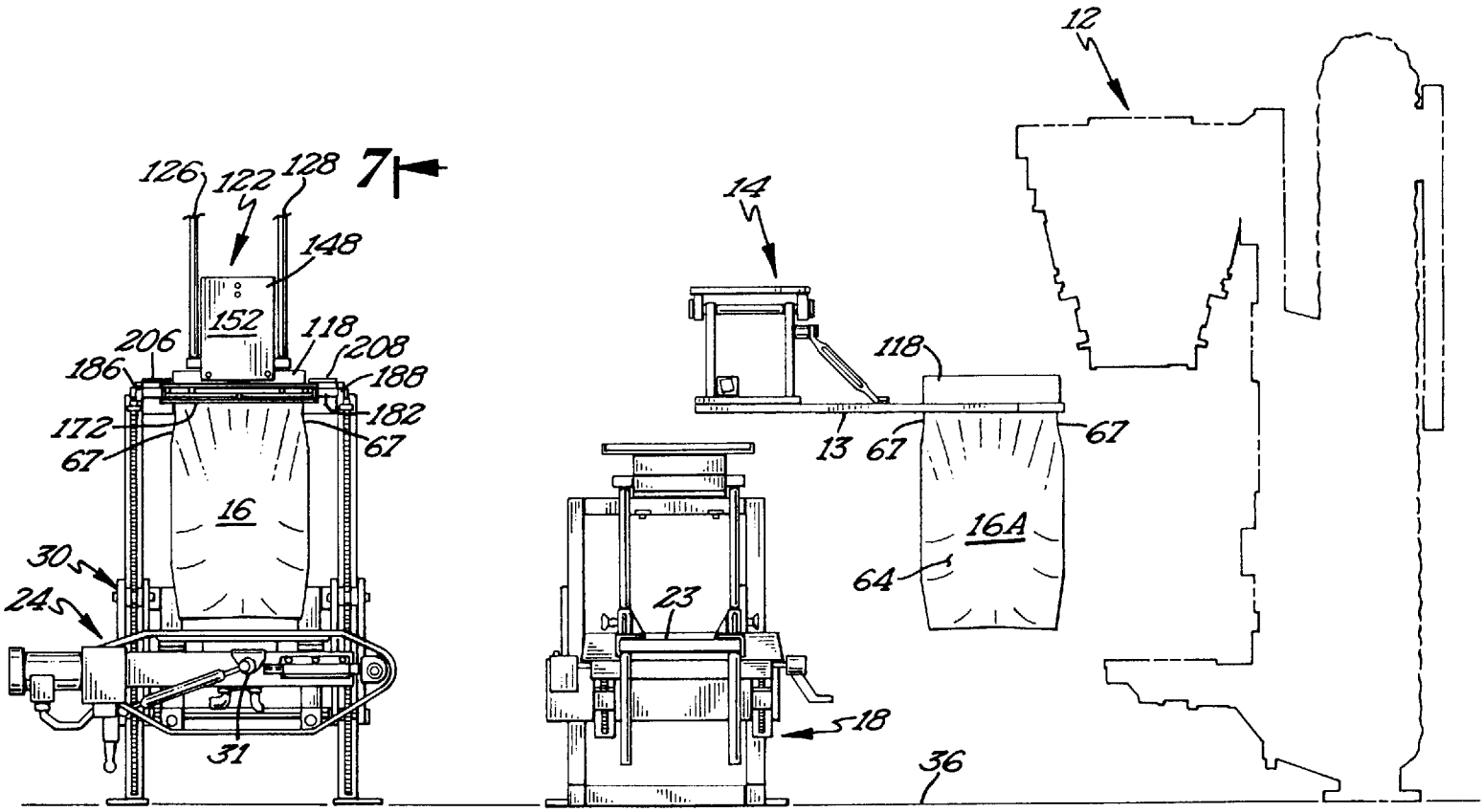
FIG. 6 is a lateral view of an automated bag filling line showing a filled bag suspended above a vibrating conveyor by a bag shouldering and deaerating apparatus of the invention.

As indicated in FIGS. 6 and 7, the bag 16 has been transported to a position above the lower stationary bag support 30, and subsequently filled bag 16A is being transported to the check weigh station 18. The bag support 30 is shown with a conveyor belt 24 configured to be vibrated from beneath by a motorized vibrator 31. Also shown is a shouldering limit switch 242 mounted under the rear shouldering assembly 124 or attached to the roller holder 234. Limit switch 242 includes a finger actuator 244 which is engaged by and moved upward by the bag shoulder, halting further downward movement of the shouldering rollers 220, 232.

Figure 8:
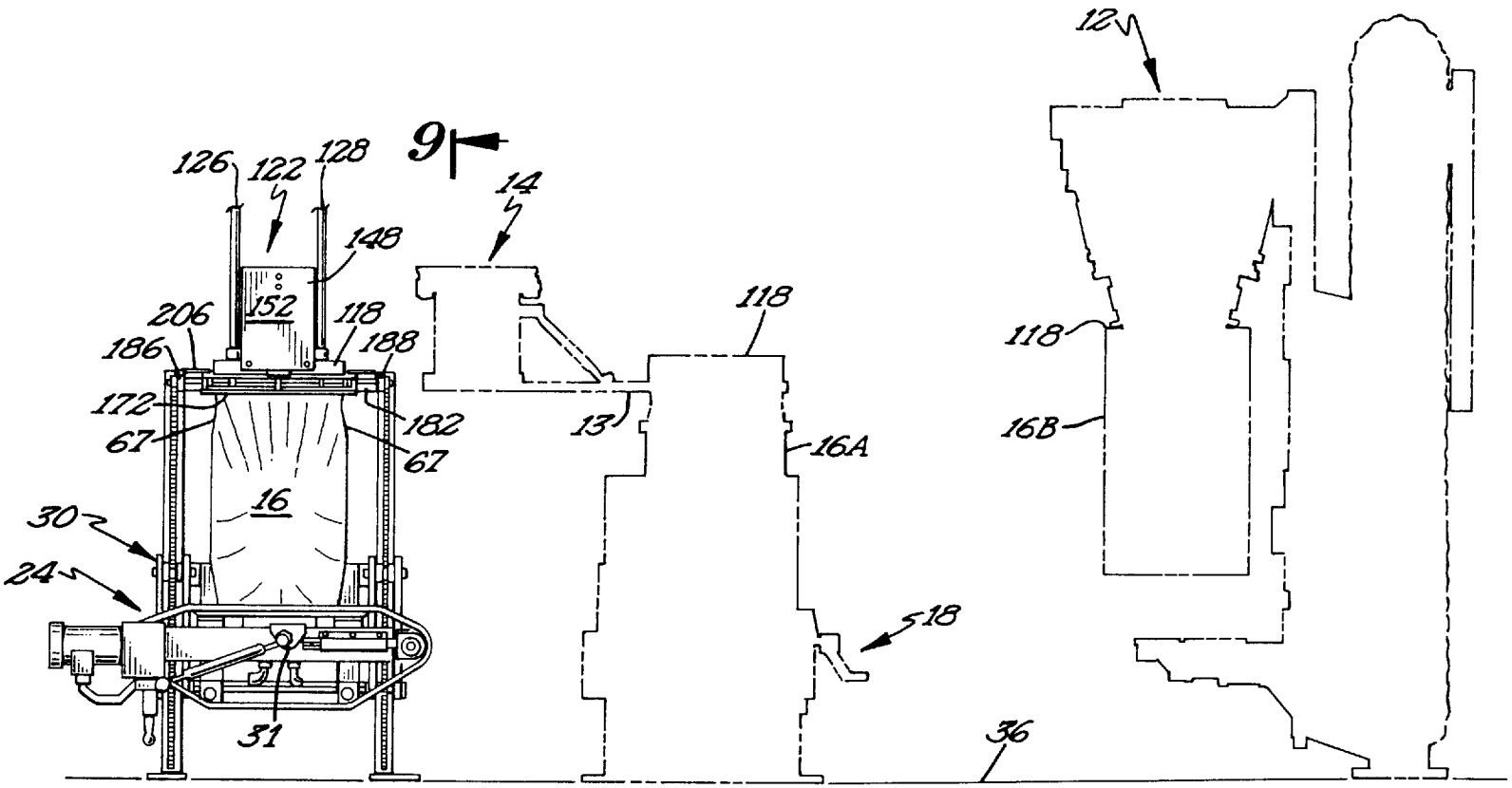
FIG. 8 is a lateral view of an automated bag fig line showing a filled bag lowered to a vibrating conveyor by a bag shouldering and deaerating apparatus of the invention.
Figures 9, 11, 12:
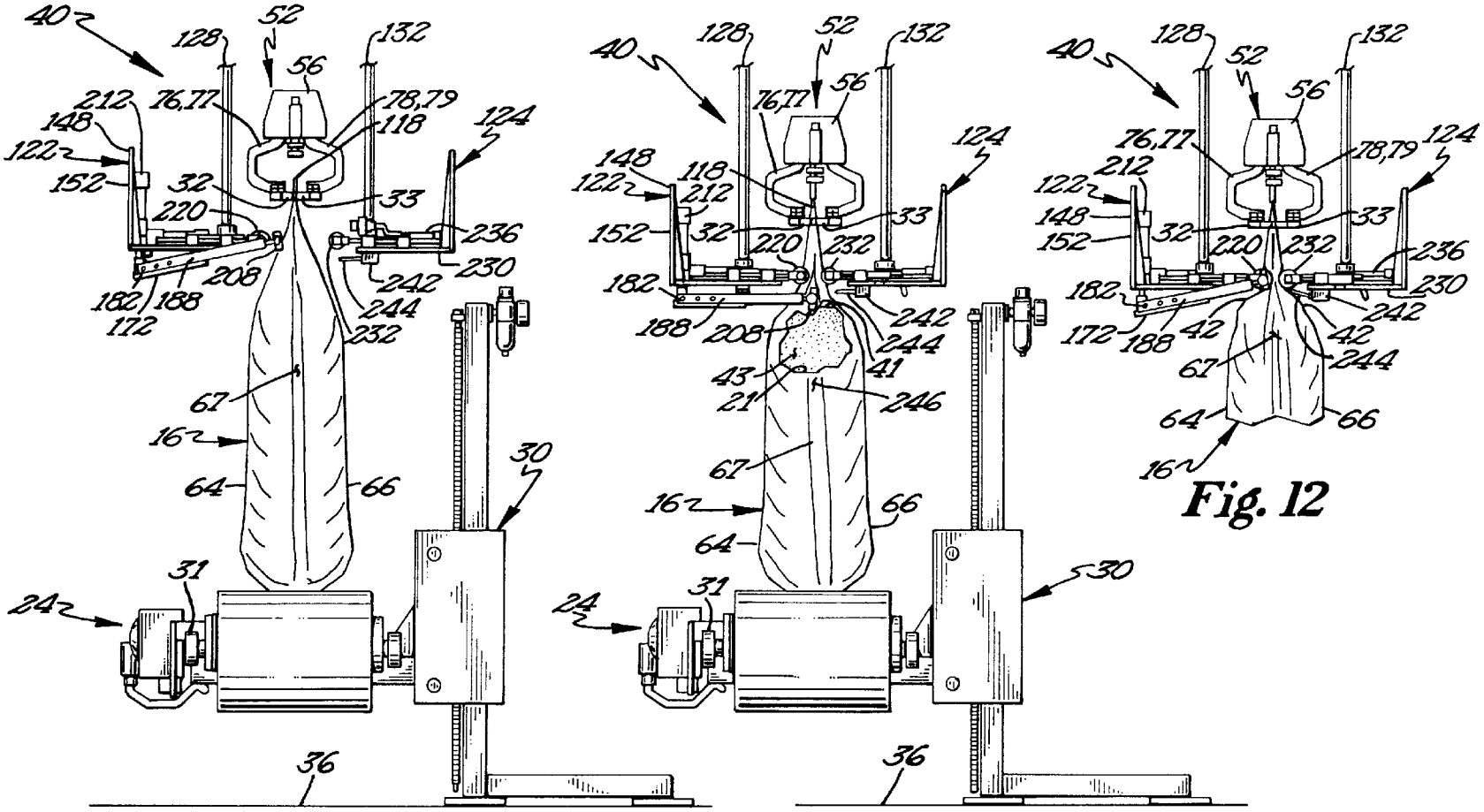
FIG. 9 is an end view of a bag shouldering and deaerating apparatus of the invention showing a filled bag placed on a vibrating conveyor, as taken along line 9—9 of FIG. 8.
FIG. 11 is an end view of a bag shouldering and deaerating apparatus of the invention, showing a gusset tucker inserted into the gusset of a filled bag and shouldering rollers in a shouldering operation, as taken along line 11—11 of FIG. 10.
FIG. 12 is a partial end view of a bag shouldering and deaerating apparatus of the invention, showing a retracted gusset tucker and shouldering rollers in a fully shouldered position.

Turning now to FIGS. 8 and 9, bag 16 is shown having been lowered to rest on the vibrating conveyor 24 for the shouldering and deaeration operation. The vibrator 31 is then activated, which consolidates the particles contained in the bag 16 to minimize the quantity of air or other gas in the interstices of the bag contents. The vibration, typically lasting for a period of less than 2 seconds to more than 10 seconds, also produces a uniform upper surface 41 of the bag contents (see FIG. 4) which minimizes bag-to-bag differences in shoulder location and final sealed bag size. As also shown in the figure, subsequent bag 16A is on the check weigh station 18, and another bag 16B is being filled at the bag filling station 12.

Figure 10:
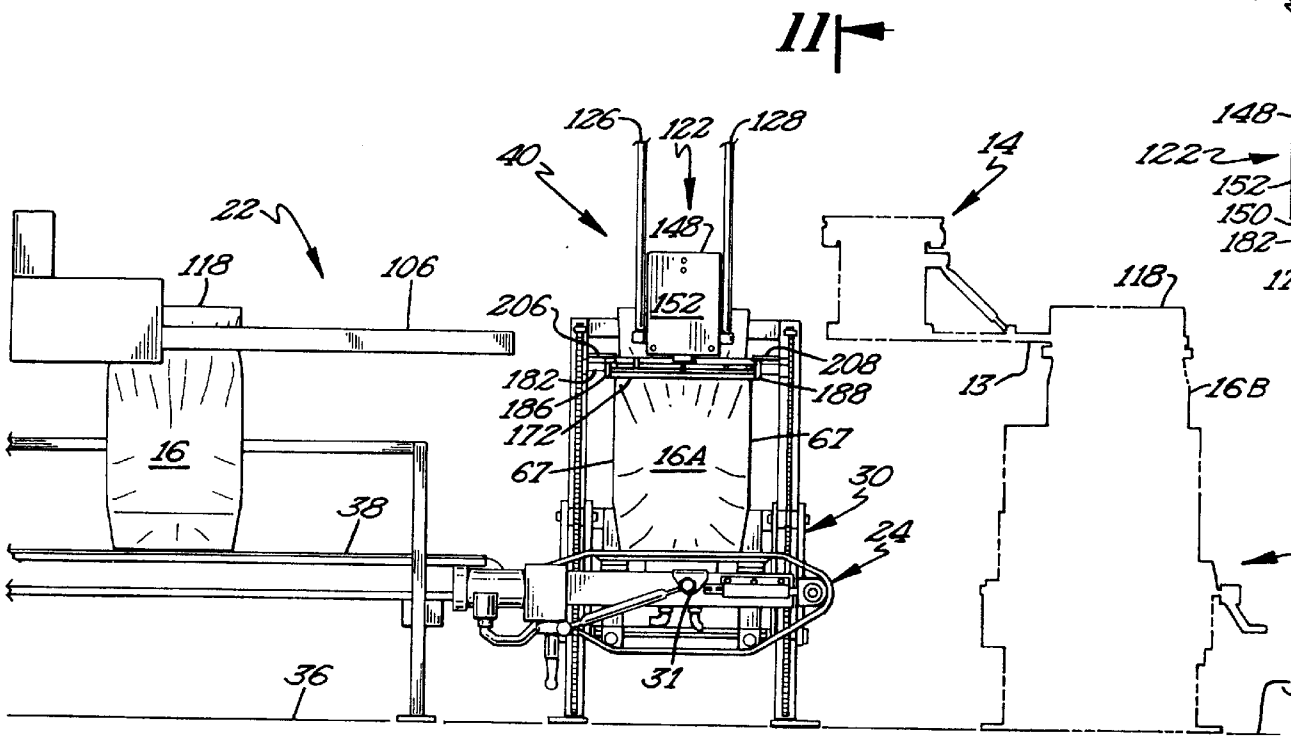
FIG. 10 is a lateral view of an automated bag filling line showing a filled bag partially shouldered by a bag shouldering and deaerating apparatus of the invention.

The next steps of the process, as illustrated in FIGS. 10 and 11, include swiveling of the tucker fingers 206 and 208 to a lower position and their insertion into the center of upper portions of the opposite gussets of bag 16 to tuck the gussets 246 into the bag. The deaerating rollers 220, 232 are projected by fluid cylinders 228 and 240, respectively, to engage and compress an upper part of the bag 16 therebetween, just above the tucker fingers 206, 208. The front and rear shouldering assemblies 122, 124 are then lowered to roll the rollers 220, 232 downward and move the gusset tuckers downward, aligning the gussets within the bag and collapsing the bag 16 above the bag contents 43. During the lowering of the rollers 220, 232, the bagtop gripper assemblies are biased upwardly with sufficient force to maintain the upper portion of the bag 16 stretched upward against the downward force of the rollers.

Figure 13:
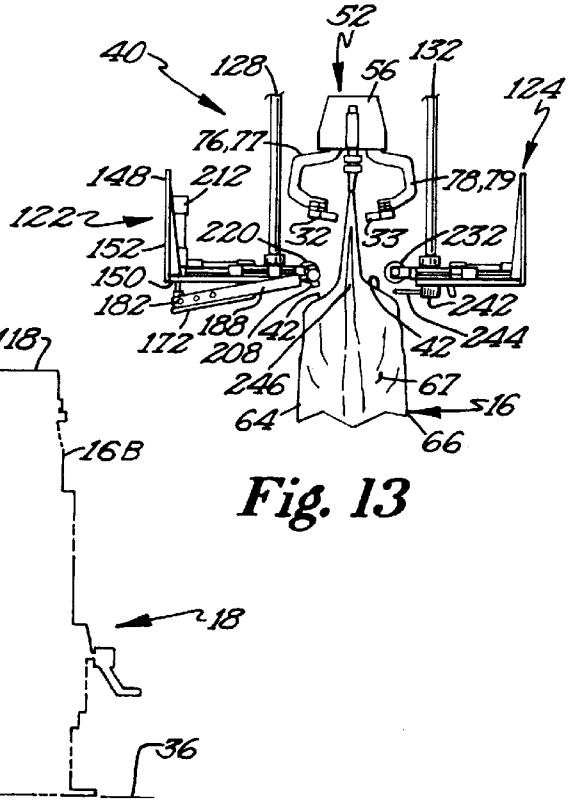
FIG. 13 is a partial end view of a bag shouldering and deaerating apparatus of the invention, showing a filled bag transported to a bag closing machine and released by the shouldering apparatus.

As shown in FIG. 12, downward movement of the shouldering assemblies 122, 124 whereby the rollers 220, 232 approach the shoulder 42 results in actuation of the limit switch actuator 244. Further downward movement of the shouldering assemblies is halted, and the gusset tucker fingers 206, 208 are pulled from the opposed gussets 246 and pivoted upward. The bag 16 may then be transported to a sealing machine 22 or other operation by shutting off the vibrator 31, starting the conveyor 24, and moving the conveyor and travelling car 28 in unison. As depicted in FIG. 13, the bag 16 is then released from the rollers by retracting the rollers 220, 232. In addition, the bagtop gripper arms 76, 77, 78 and 79 are opened to fully release the bag 16. The travelling car 28 with bagtop gripper assemblies 52, 54 and shouldering assemblies 122, 124, then returns to pick up another bag 16A at the check weigh station 18.

It should be noted that the operations may be synchronized so that the filling, weigh checking, shouldering, and sealing operations take place simultaneously, with different bags. Thus, throughput may be maximized.

The downward roller movement of this device has distinct advantages over rolling upwardly. The latter method would require insertion of the opposed roller above the contents level 41 prior to rolling upward. Additional structure would be required to detect the shoulder-to-be, and to hold the bag faces together just above the contents level 41 while the rollers move upwardly. In this method, the major portion of air would be rapidly expelled from the bag as the rollers are moved into and against the bag faces. This will tend to entrain more of the particulate contents in the air and expel the particles into the atmosphere. In the present invention, air is uniformly expelled during the entire downward movement of the rollers rather than primarily in a brief high flow period prior to rolling. Bag shouldering and deaeration by rolling the filled bag downwardly not only results in less loss of contents and a simpler apparatus, but the time consumed in the step is significantly reduced.

Use of the drive motors with the indexing apparatus and belt drives permits quick adjustment of starting and stopping points from a computer terminal, with out stopping the machine. Thus, changes in bag sizes and types may be easily and quickly accommodated.

The apparatus described herein effectively removes free space from filled bags, resulting in bags which are more compact, much more difficult to break, and which are more effectively stacked on a pallet. The space occupied by the bags in transit or storage is minimized. The time required for shouldering/deaerating is minimal, and the apparatus occupies a small space in the bagging line.

It is anticipated that various changes and modifications may be made in the construction, arrangement, operation and method of construction of the bag shouldering and deaerating apparatus disclosed herein without departing from the spirit and scope of the invention as defined in the following claims.

What is claimed is:

1. An apparatus for shouldering and deaerating a bag containing granular material and having a top opening and a bottom, said apparatus comprising:

bag gripping means for holding an upper portion of a material containing bag having opposed front and rear faces defining the bag width;

opposed roller assemblies laterally disposed adjacent opposed front and rear faces of the bag, said roller assemblies comprising a pair of opposed rollers configured to compressively impinge against opposite faces of the bag across the width thereof, said rollers being further configured to cooperate with each other in such a way as to define escape passage means for gas release from within the bag as the rollers move along the length of the bag faces in a second compression position;

means for moving the opposed rollers between a first position laterally spaced from the front and rear bag faces and a second bag compression position against the front and rear bag faces below the bag gripping means; and means for moving the opposed rollers generally vertically along the length of the front and rear bag faces with the rollers in the second, bag compression positions to progressively collapse the upper portion of the bag above the upper level of granular material contained therein to expel gas from the bag.

2. The apparatus of claim 1, wherein said bag has side gussets, said apparatus further comprising:

gusset aligning means for aligning and maintaining opposed bagtop gussets above the level of said material, said aligning and maintaining means insertable in said bagtop gussets below the bag gripping means and movable downwardly above the level of said material.

3. The apparatus of claim 1, further comprising timing and control means for coordinating the movement of the bag gripping means and the roller assemblies.

4. The apparatus of claim 1, further comprising means for supporting said bag during movement of the rollers; and a traveling car, with said bag gripping means and roller assemblies mounted on the traveling car for lateral movement therewith, and the traveling car being reversibly moveable laterally between said supporting means and an upstream station and between said supporting means and a downstream station.

5. The apparatus of claim 1, further comprising means for compacting and deaerating the material in the bag during downward movement of the rollers, said compacting and deaerating means comprising a vibrating platform on which the filled bag rests during movement of the rollers vertically.

6. The apparatus of claim 1, wherein the means for moving the rollers along the front and rear bag faces is constructed and arranged to move the rollers downwardly in a direction from the bag top opening towards the bag bottom with the rollers in the second bag compression position to collapse the upper portion of the bag; and means for stopping downward movement of the rollers along the length of the front and rear bag faces and actuating said means for moving the rollers between said first and second positions to retract the rollers to said first positions in response to movement of the rollers to a position in which the bag is collapsed to the upper level of the material contained therein.

7. The apparatus of claim 6, further comprising biasing apparatus constructed and arranged to selectively apply a controlled, upwardly biased resistance to the bag gripping means to resist downward movement of the upper portion of the bag during downward movement of the rollers in contact therewith.

8. The apparatus of claim 7, wherein the biasing means includes a servomotor which applies a selected resistance to downward movement of the bag.

9. The apparatus of claim 8, wherein the biasing means includes a fluid cylinder for applying a selected resistance to downward movement of the bag.

10. The apparatus of claim 1, wherein said means for moving the opposed rollers between said first and second positions provides a preselected compressive force on the rollers.

11. The apparatus of claim 10 wherein said means for moving the opposed rollers between said first and second positions comprises at least one servomotor.

12. The apparatus of claim 10, wherein said means for moving the opposed rollers between said first and second positions comprises at least one air cylinder mounted to bias at least one of said opposed rollers against at least one said face of the bag to compress the bag faces between the said rollers with a preselected force.

13. The apparatus of claim 6 wherein said means for stopping downward movement of the rollers comprises switch means to detect close proximity of the opposed rollers to the contents level within the bag and halt downward movement of the rollers.

14. The apparatus of claim 4, wherein said supporting means comprises a vibrating platform on which the bag rests during movement of the rollers.

15. The apparatus of claim 1, wherein the opposed rollers are configured to have cooperatively aligned spaces intermittent their lengths to provide said gas escape passage means.

16. The apparatus of claim 1, wherein the opposed rollers are configured to extend less than the entire width of the front and rear faces of a filled bag, thereby defining said gas escape passage means as two separate flow passages along the vertical side walls of the bag.

17. An apparatus for placement in a bag handling line for shouldering and deaerating a bag previously filled with granular material and having a front face, a rear face and a top opening, said apparatus comprising:

a vibrating platform for placement and support of a filled bag thereon for shouldering and deaerating;

a traveling car having bagtop grippers mounted thereon, said car configured to move laterally between an upstream station in said line at a position adjacent said vibrating platform and a downstream station for carrying a bag therebetween, said bagtop grippers being vertically movable; and front and rear shouldering assemblies mounted on said car to be positioned adjacent opposing faces of the bag, each said shouldering assembly including a horizontal roller movable against a face of the bag whereby upper portions of the bag faces are compressed together between the rollers, said shouldering assemblies movably mounted to move said rollers generally vertically over said front and rear bag faces between an upper position and a lower position to collapse the bag above the level of granular material contained therein to expel gas from the bag.

* * * * *